US008712273B2

(12) United States Patent
Kadowaki

(10) Patent No.: US 8,712,273 B2
(45) Date of Patent: Apr. 29, 2014

(54) FIXING APPARATUS

(75) Inventor: Hiroyuki Kadowaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 13/406,271

(22) Filed: Feb. 27, 2012

(65) Prior Publication Data

US 2012/0224875 A1 Sep. 6, 2012

(30) Foreign Application Priority Data

Mar. 1, 2011 (JP) ..... 2011-044070

(51) Int. Cl.
*G03G 15/20* (2006.01)
*H05B 11/00* (2006.01)

(52) U.S. Cl.
USPC ..... 399/69; 399/329; 219/216

(58) Field of Classification Search
USPC ..... 399/69, 329
See application file for complete search history.

(56) References Cited

U.S. PATENT DOCUMENTS

| | | | | |
|---|---|---|---|---|
| 5,249,024 | A * | 9/1993 | Menjo | 399/45 |
| 6,603,936 | B2 * | 8/2003 | Murata et al. | 399/69 |
| 2007/0104503 | A1 * | 5/2007 | Kubo et al. | 399/67 |
| 2009/0123170 | A1 * | 5/2009 | Tatematsu et al. | 399/68 |
| 2009/0196643 | A1 * | 8/2009 | Mito et al. | 399/69 |
| 2011/0217057 | A1 * | 9/2011 | Yoshinaga et al. | 399/33 |
| 2012/0107003 | A1 * | 5/2012 | Hasegawa | 399/69 |

FOREIGN PATENT DOCUMENTS

JP 2003-323965 A 11/2003

* cited by examiner

*Primary Examiner* — David Gray
*Assistant Examiner* — Francis Gray
(74) *Attorney, Agent, or Firm* — Canon USA Inc IP Division

(57) ABSTRACT

The present disclosure is directed to enhance thermal efficiency of a fixing apparatus while a belt of the apparatus is heated, the fixing apparatus including: a belt including a plurality of heaters therein; a nip forming member that contacts with an inner surface of the belt; and a pressure member that forms a nip portion in conjunction with the nip forming member through the belt, wherein a ratio of an amount of heat generation by a heater farther from the nip portion to another heater closer to the nip portion is changed according to a speed at which a recording material is conveyed.

12 Claims, 3 Drawing Sheets

FIXING APPARATUS

BACKGROUND OF THE INVENTION

1. Field of the Invention

The present invention relates to a fixing apparatus equipped with a belt.

2. Description of the Related Art

On-demand control of a fixing apparatus is one approach to achieve high-speed start-up and energy saving of a fixing apparatus. To realize the on-demand control, some fixing apparatuses use an endless thin belt as a rotatable heating member. The thin belt has a smaller heat capacity as compared to those of conventional thick heating rollers, enabling saving in time for warm-up of the fixing apparatuses and reduction in power consumption at the warm-up.

In the cases where the thin belt consisted of a base layer and a release layer is used as a belt equipped in an on-demand fixing apparatus, sometimes uniform fixability cannot be obtained when the image requires a large amount of toner to be fixed on a recording material. In addition, when a sheet of plain paper having an uneven surface is used in the fixing apparatus, sometimes toner fusion of a toner image is changed in various ways leading to uneven brightness on the surface of the image after fixing.

Japanese Patent Application Laid-Open No. 2003-323965 discusses a fixing belt including an elastic layer, which is made of silicone rubber for example, to be interposed between a base layer and a release layer of the fixing belt.

The elastic layer provided in the belt, however, decreases the heat transfer coefficient from the back surface to the front surface of the belt.

The belt moves a distance l for a period of time t, the distance being given by: l=(t)(v) (mm) where t (sec) is the time that takes the thermal energy output from a heater to be transferred to the outer surface of the belt, and v (mm/sec) is the rotation speed of the belt. Thus, if the heater heats a certain point of the inner surface of the belt, when the heat is completely transferred to the outer surface of the belt, the belt is to move downstream in the rotation direction by a distance l. In other words, a smaller thermal conductivity between the front and back surfaces of a belt and a higher rotation speed of the belt result in a larger distance l. This result causes a problem in that a sufficient thermal flow cannot be supplied to the belt surface on the opposite side to the heater while a recording material passes through a nip portion, and poor fixability is likely to occur on the material.

SUMMARY OF THE INVENTION

The present disclosure is directed to a fixing apparatus providing both on-demand control and good fixability.

According to an aspect disclosed herein, a fixing apparatus that makes a toner image on a recording material fix onto the recording material, including: a cylindrical belt; a plurality of heaters disposed interior to the belt; a nip forming member contacting with an inner surface of the belt; a pressure member forming a nip portion in conjunction with the nip forming member through the belt; a temperature detection member that detects a temperature of the belt or the nip forming member; and a control unit configured to control an amount of heat generated by the plurality of heaters such that a temperature detected by the temperature detection member becomes a target temperature, wherein the apparatus includes, among the plurality of heaters, a first heater and a second heater disposed at a position farther from the nip portion than the first heater, wherein the apparatus can be operated in a first fixing process mode and a second fixing process mode in which the belt is conveyed at a lower speed than in the first fixing mode, and wherein the control unit controls such that, during fixing of the toner image onto the recording material, the ratio of an amount of heat generated by the first heater to the second heater in the first fixing process mode is smaller than the ratio of that in the second fixing process mode.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment is described.

Figure 1A:
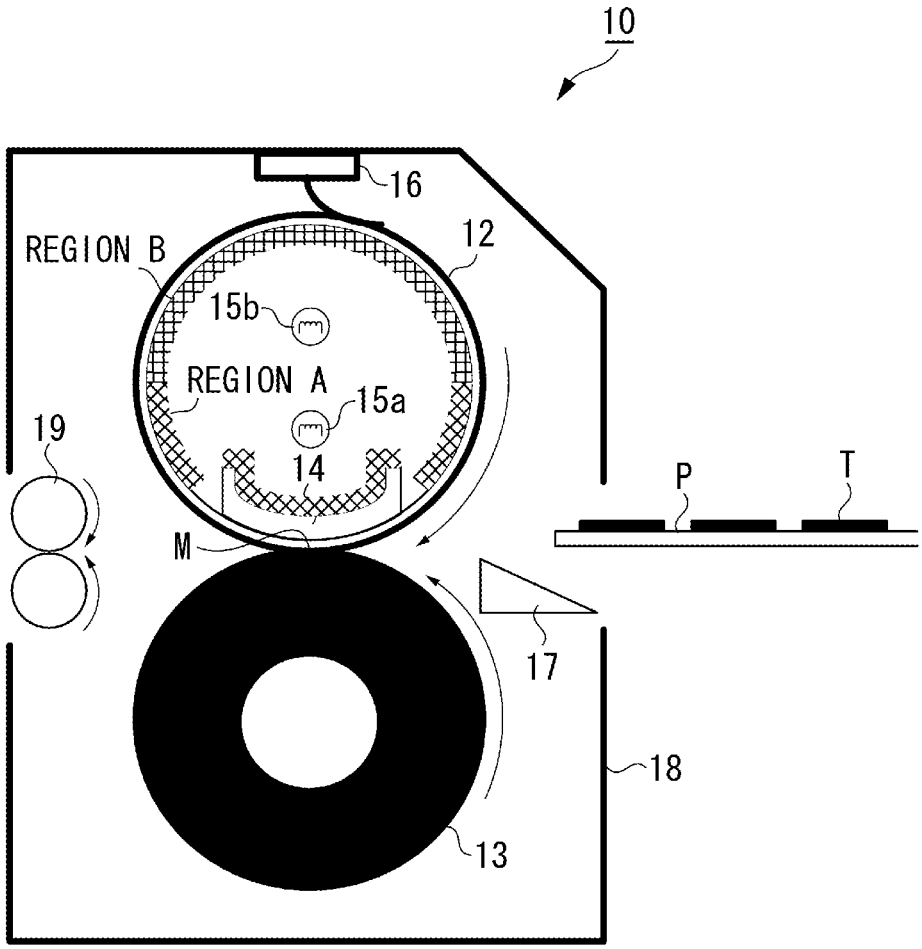
FIGS. 1A and 1B each illustrate a structure of a fixing apparatus according to a first exemplary embodiment.
Figure 1B:
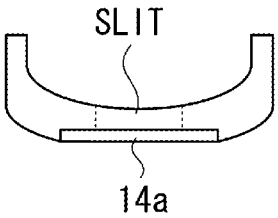

FIG. 1A schematically illustrates a fixing apparatus 10. The fixing apparatus 10 includes a belt 12 as a rotatable heating member. The belt 12 at least includes: a stainless steel base layer having a thickness of 20 to 200 μm and formed into a hollow cylinder of an inner diameter of 30 mm; and a silicone rubber layer (i.e., an elastic layer) having a thickness 200 to 1000 μm and covering the base layer. Furthermore, a fluoro resin layer (i.e., the outermost layer) is coated over the elastic layer. The stainless steel of the base layer of the belt 12 has a thermal conductivity of 10 W/m·K or more, and a heat capacity of 4 $J/m^2 \cdot K$ or more. The silicone rubber of the elastic layer has a thermal conductivity of 1.0 W/m·K or more, and a heat capacity of 1.5 $J/m^2 \cdot K$ or more. The outermost fluoro resin layer has a thermal conductivity of 0.1 W/m·K or more, and a heat capacity of 2.0 $J/m^2 \cdot K$ or more.

The base layer of the belt 12 may be made of polyimide instead of stainless steel. However, the stainless steel has a thermal conductivity larger than that of polyimide, and provides higher on-demand performance. Accordingly, in the present exemplary embodiment, stainless steel is used as the base layer.

A pressure roller 13 is a pressure member. The pressure roller 13 has a silicone rubber layer of a thickness 1 to 10 mm formed by injection molding over a stainless steel bar having a core and having an outer diameter of 20 mm. The silicone rubber layer is covered with a fluoro resin layer to prevent toner contamination. In the present exemplary embodiment, the silicone rubber layer of the pressure roller 13 has a thermal conductivity of 0.2 W/m·K or more, and a heat capacity of 1.0 $J/m^2 \cdot K$ or more, and the fluoro resin layer has a thermal conductivity of 0.1 W/m·K or more, and a heat capacity of 2.0 $J/m^2 \cdot K$ or more. The pressure roller 13 is driven by a driving apparatus (not illustrated) to rotate counter-clockwise as indicated by the arrow at a predetermined speed.

A belt guide 14 is an arc-like tank shaped member having heat resistance and rigidity. The belt guide 14 holds a sliding plate 14*a* (i.e., a nip forming member) as illustrated in FIG.

1B, which provides a nip portion M. The belt guide 14 is provided with a slit so that radiant heat from a halogen heater 15*a* directly hits the sliding plate 14 through the slit. In the present exemplary embodiment, the pressure roller 13 works with the sliding plate 14*a* (i.e., the nip forming member) through the belt 12 to form the nip portion.

The belt 12 is disposed to loosely fit to the exterior of the belt guide 14.

The sliding plate 14*a* held by the belt guide 14 is made of a metal having a high thermal conductivity to obtain a uniform temperature distribution over the nip portion M. Examples of the metal include stainless steel, iron, aluminum, copper, magnesium, and their alloys. Since the metal sliding plate 14*a* slides in contact with the inner surface of the belt 12, the metal sliding plate 14*a* is coated with fluoro resin or glass.

The portion of the belt guide 14 holding sliding plate 14*a* is made of a material having heat resistance and high rigidity, such as ceramic. The portion may be made of a metal such as stainless steel, iron, aluminum, copper, magnesium, or their alloys, to secure a mechanical strength sufficient to withstand a pressure applied by the pressure roller 13.

Drive rotation of the pressure roller 13 causes frictional force at the nip portion M between the pressure roller 13 and the outer surface of the belt 12. The frictional force causes the belt 12 to rotate.

Halogen heaters 15*a* and 15*b* are disposed within the hollow cylinder of the belt 12, as first and second heaters respectively.

In the present exemplary embodiment, the halogen heater 15*a* has a rated power of 800 W, and the halogen heater 15*b* has a rated power of 500 W. This provides the setting of a 1300 W maximum power at the simultaneous use of the heaters 15*a* and 15*b*.

As illustrated in FIG. 1A, the halogen heaters 15*a* and 15*b* are arranged in a line one above the other in the direction perpendicular to the conveyance direction of a recording material P.

The halogen heater 15*a* is disposed at a position closer to the nip portion M.

The halogen heater 15*b* is farther from the nip portion M than the halogen heater 15*a*, and is closer to the portion of the belt 12 opposite the nip portion M. The radiant light emitted from the halogen heater 15*a* mainly heats up the belt guide 14, the sliding plate 14*a*, and the regions of the inner surface of the belt 12 near the nip portion M (i.e. the region A in FIG. 1A).

The radiant light emitted from the halogen heater 15*b* mainly heats up the region of the inner surface of the belt 12 opposite the nip portion M (i.e. the region B in FIG. 1A).

The heaters 15*a* and 15*b* may be of any type that can radiate infrared light in an efficient and quick manner. Halogen heaters are but one of many types of acceptable heaters that may be used. Xenon lamps, for example, may be used. The halogen heaters 15*a* and 15*b* of the exemplary embodiment are capable of radiating infrared light having a wavelength of 0.8 lam or more at a high efficiency of 85% or more of an input power. The radiation is performed based on heat-up of a tungsten filament having a small heat capacity, providing a quick start up and good responsiveness. The halogen heaters 15*a* and 15*b* have a common light distribution that provides a uniform light intensity on the region where sheets pass.

A thermistor 16 operates as a temperature detection unit. The thermistor 16 is disposed to resiliently contact with the outer surface of the belt 12 from a position outside of the belt 12, and detects the temperature of the outer surface of the belt 12.

The thermistor 16 is connected to a control circuit unit (CPU). The control circuit unit controls power supply to the halogen heaters 15*a* and 15*b* using a heater drive circuit unit which operates as a power supply unit, so that the temperature detected by the thermistor 16 becomes a target temperature.

The thermistor 16 may detect the temperature of the sliding plate 14*a* in lieu of the temperature of the belt 12.

The fixing apparatus 10 further includes an inlet guide 17 and a discharge roller 19. The inlet guide 17 is installed to guide the recording material P precisely to the nip portion M. The inlet guide 17 of the present exemplary embodiment is made of polyphenylene sulfide (PPS) resin.

Next, fixing operation of the present exemplary embodiment is described. As the pressure roller 13 is rotatably driven by a drive source (not illustrate), the belt 12 is in turn rotatably driven. Upon start of the rotations, power is supplied to the halogen heaters 15*a* and 15*b* to start warm-up.

The "warm-up" refers to a power supply control by the control unit until a detected temperature of the thermistor 16 becomes a target temperature, after the power supply to the halogen heaters 15*a* and 15*b*.

After completion of the warm-up, the recording material P bearing an unfixed toner image thereon is guided to the nip portion M by the inlet guide 17. At the nip portion, fixing of the image is started.

While the recording material P is conveyed, the heat of the belt 12 heated by the halogen heaters 15*a* and 15*b* is transferred to the recording material P, and the unfixed toner image on the recording material P is fixed thereon. The recording material P, after passing through the nip portion M, is curvature separated from the belt 12 to be discharged by the discharge roller 19.

Next, a control sequence of the fixing apparatus 10 in the present exemplary embodiment is described.

In the present exemplary embodiment, temperature control is performed so that the outer surface of the belt 12 becomes a target temperature, through turning on/off of the power supply to the halogen heaters 15*a* and 15*b*. In the present exemplary embodiment, a turn-on ratio between the halogen heater 15*a* and the halogen heater 15*b* (i.e., a ratio between the amounts of heat generation) is changeable.

Figure 2A:
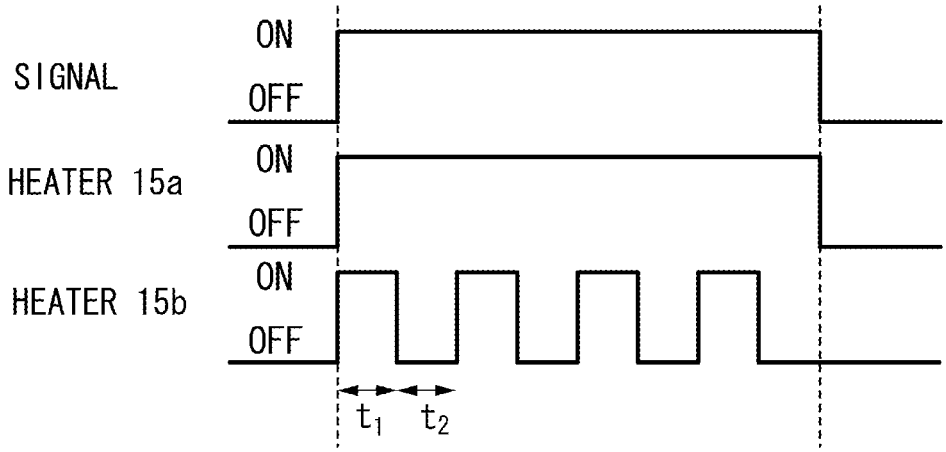
FIGS. 2A, 2B, and 2C each illustrate turning on/off states of two heaters in the first exemplary embodiment.
Figure 2B:
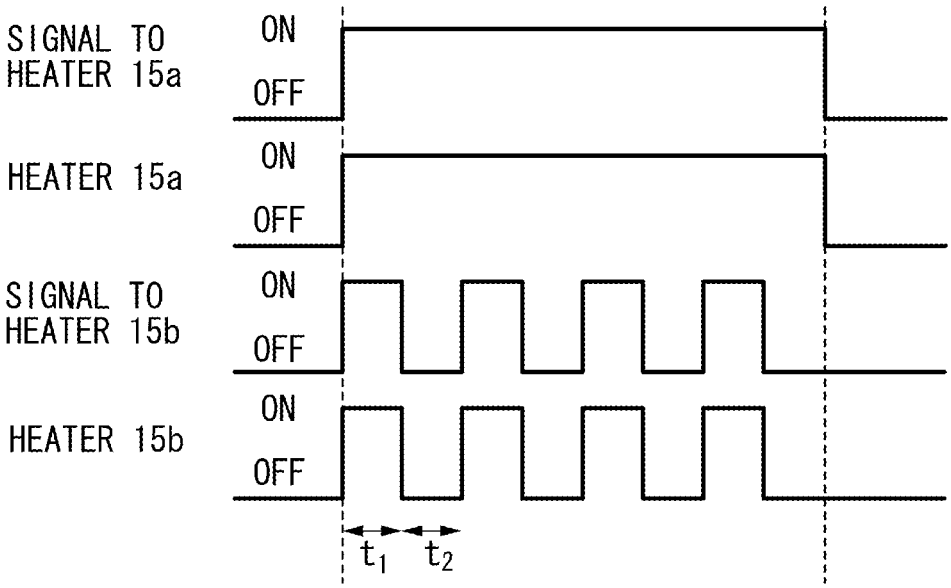
Figure 2C:
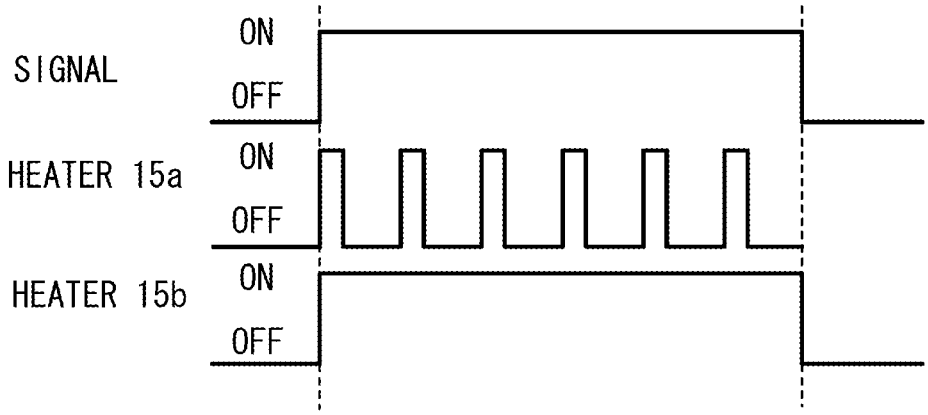

Generally, unless otherwise specified, "a lower turn-on ratio corresponds to a longer turning-off time." For example, in the case where the two halogen heaters 15*a* and 15*b* are set to have a turn-on ratio of 15*a*:15*b*=2:1, when the control circuit unit issues an instruction to supply power (i.e., upon generation of an ON signal), power is supplied to the halogen heaters 15*a* and 15*b* as illustrated in FIG. 2A. In the present exemplary embodiment, the power ON time $t_1$ and the power OFF time $t_2$ in FIG. 2A are controlled to control the power supply ratio. In FIG. 2A, the power ON time $t_1$ and the power OFF time $t_2$ are set to 100 msec and 100 msec respectively. The halogen heaters 15*a* and 15*b* may be provided, independently of each other, with ON/Off signals. In this case, the halogen heaters 15*a* and 15*b* are supplied with power as illustrated in FIG. 2B.

The thermistor 16 is connected to the control circuit unit (CPU). The control circuit unit controls power supply to the halogen heaters 15*a* and 15*b* using a heater drive circuit unit which operates as a power supply unit so that the temperature detected by the thermistor 16 becomes a target temperature.

In the present exemplary embodiment, the turn-on ratio between the halogen heater 15*a* and the halogen heater 15*b* is set according to a process speed, as illustrated in Table 1.

TABLE 1

| Process Speed | Turn-on Ratio (15a:15b) At Warm-Up | At Fixing |
|---|---|---|
| 1/1 Speed | 1:1 | 1:5 |
| 1/2 Speed | 1:1 | 1:1 |
| 1/3 Speed | 1:1 | 5:2 |

The 1/1 speed of the process speed corresponds to a maximum conveyance speed of the recording material P (i.e., 180 mm/sec in the present exemplary embodiment). The 1/2 and 1/3 speed of the process speeds respectively correspond to one half of the maximum conveyance speed of the recording material P (i.e., 90 mm/sec), and one third of the maximum conveyance speed of the recording material P (i.e., 60 mm/sec). The process speed is varied depending on a grammage (g/m$^2$) or thickness of the recording material P. As disclosed herein, the term "grammage" will be understood by the skilled artisan to mean the weight of one square meter sheet of paper in grams. A larger grammage (g/m$^2$) or thickness of the recording material P results in a larger heat capacity of the recording material P, and a larger amount of heat absorbed by the recording material P at fixing. Thus, the process speed is decreased so that a larger amount of heat is given to the recording material P at fixing when the recording material P has a larger grammage (g/m$^2$) or thickness.

The turn-on ratio between the halogen heater 15*a* and the halogen heater 15*b* at warm-up is described.

At warm-up, the fixing apparatus can be entirely heated for a higher thermal efficiency resulting in a shorter period of time required for the warm-up. Specifically, members such as the belt guide 14 having a relatively larger heat capacity may be disposed near the nip portion M. Insufficient heating of the members having relatively larger heat capacities increases the time required for the warm-up, because these members continue to absorb the heat even if the fixing belt 12 is sufficiently heated.

Accordingly, at warm-up, the turn-on ratio between the halogen heater 15*a* and the halogen heater 15*b* is set to 1:1, and power is supplied to the heaters 15*a* and 15*b* to become the maximum power. As described above, the halogen heater 15*a* has a rated power of 800 W, whereas the halogen heater 15*b* has a rated power of 500 W. Thus, the halogen heater 15*a* generates a larger amount of heat than the halogen heater 15*b*.

At warm-up, the turn-on ratio of the halogen heater 15*a*, which is closer to the nip portion M, may be increased. To sum up the above description, at warm-up, the turn-on ratio can be equal between the halogen heater 15*a* and the halogen heater 15*b*, or the turn-on ratio of the halogen heater 15*a* can be higher than that of the halogen heater 15*b*.

Next, fixing is described. In a fixing apparatus equipped with the belt 12 having an elastic layer like that of the present exemplary embodiment, the thermal conductivity in the thickness direction of the belt 12 is likely to decrease. Accordingly, it takes time for the heat being transferred from the inner surface to the outer surface of the belt 12 after heating of the belt 12 starts.

Hereinafter, the region of the belt 12 located closer to the halogen heater 15*a* or the halogen heater 15*b* in the circumferential direction of the belt 12 and having a temperature raised more than that of the other region around by radiant heat from the halogen heater is referred to as "heated belt region."

The heated belt region having a temperature raised by the radiant heat from the halogen heater 15*a* or the halogen heater 15*b* moves along with the rotation of the belt 12. The time required for the heated belt region to reach the nip portion M varies depending on the rotation speed of the belt 12, the rotation speed being set according to a process speed.

In the present exemplary embodiment, independently of the process speed, the heat of the heated belt region is set to transferred to the outer surface of the belt 12 just before the heated belt region reaches the nip portion M.

To achieve the transfer, in the present exemplary embodiment, a turn-on ratio between the halogen heater 15*a* and the halogen heater 15*b* (i.e., the ratio of amounts of heat generation) is changed according to a process speed. The method of changing a turn-on ratio is described.

The halogen heater 15*a* mainly heats up the region of the belt 12 near the nip portion M (i.e., the region A in FIG. 1A), the sliding plate 14*a*, and the belt guide 14. The halogen heater 15*b* mainly heats up the region of the inner surface of the belt 12 opposite the nip portion M (i.e. the region B in FIG. 1A).

In the fixing process mode (i.e., a first fixing process mode) with a higher process speed such as 1/1 speed, the turn-on ratio of the halogen heater 15*b* is increased, and the region B in FIG. 1A is set as the heated belt region to be mainly heated. This is because the belt 12 rotates at a high rotation speed in the first fixing process mode and thereby the time required for the heated belt region to reach the nip portion M needs to be increased.

In the fixing process mode (i.e., a second fixing process mode) with a lower process speed such as 1/3 speed, the turn-on ratio of the halogen heater 15*a* is increased, and the region A in FIG. 1A is set as the heated belt region to be mainly heated. This is because the belt 12 rotates at a low rotation speed in the second fixing process mode and thereby it takes a long time for the heated belt region to reach the nip portion M, which may result in heat dissipation.

As seen from the above description, both thermal efficiency and fixability can be enhanced in the first fixing process mode, as compared to the second fixing process mode, with a smaller turn-on ratio of the halogen heater 15*a* to the halogen heater 15*b*.

Consequently, according to the present exemplary embodiment, the fixing apparatus equipped with a belt having an elastic layer can provide both of on-demand management and fixability.

In the present exemplary embodiment, two halogen heaters are used as examples of heaters located within the belt 12, but the number of heaters is not limited as long as a plurality of heaters is installed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-044070 filed Mar. 1, 2011, which is hereby incorporated by reference herein in its entirety.

What is claimed is:

1. A fixing apparatus configured to make a toner image on a recording material fix onto the recording material, comprising:

a cylindrical belt;

a plurality of heaters disposed interior to the belt;

a nip forming member contacting with an inner surface of the belt;

a pressure member forming a nip portion in conjunction with the nip forming member through the belt;

a temperature detection member detecting a temperature of the belt or the nip forming member; and a control unit configured to control the plurality of heaters such that a temperature detected by the temperature detection member becomes a target temperature, wherein the apparatus includes, among the plurality of heaters, a first heater and a second heater disposed at a position farther from the nip portion than the first heater, wherein the apparatus can be operated in a first fixing process mode and a second fixing process mode in which the belt is conveyed at a lower speed than in the first fixing mode, wherein the control unit controls the first heater and the second heater so that an amount of heat generation by the second heater is larger than an amount of heat generation by the first heater when the apparatus fixes the toner image on the recording material in the first fixing process mode, and wherein the control unit controls the first heater and the second heater so that the amount of heat generation by the first heater is larger than the amount of heat generation by the second heater when the apparatus fixes the toner image on the recording material in the second fixing process mode.

2. The fixing apparatus according to claim 1, wherein a grammage of the recording material on which the toner image is fixed in the second fixing process mode is larger than that in the first fixing process mode.

3. The fixing apparatus according to claim 1, wherein, the amount of heat generation by the first heater is controlled to become greater than the amount of heat generation by the second heater during warm-up of the apparatus.

4. The fixing apparatus according to claim 3, wherein a rated power of the first heater is greater than that of the second heater.

5. The fixing apparatus according claim 1, wherein a turn-on ration of the second heater to the first heater when the apparatus fixes the toner image on the recording material in the first fixing process mode is larger than that in the second fixing process mode.

6. The fixing apparatus according to claim 1, wherein the belt has a base layer and a rubber layer covering the base layer.

7. A fixing apparatus configured to make a toner image on a recording material fix onto the recording material, comprising:

a cylindrical belt;

a first heater disposed interior to the belt;

a second heater disposed interior to the belt and at a position farther from the nip portion than the first heater;

a nip forming member contacting with an inner surface of the belt;

a pressure member forming a nip portion in conjunction with the nip forming member through the belt; and a control unit configured to control the first heater and the second heater, wherein the apparatus can be operated in a first fixing process mode and a second fixing process mode in which the belt is conveyed at a lower speed than in the first fixing mode, wherein the control unit controls the first heater and the second heater so that an amount of heat generation by the second heater is larger than an amount of heat generation by the first heater when the apparatus fixes the toner image on the recording material in the first fixing process mode, and wherein the control unit controls the first heater and the second heater so that the amount of heat generation by the first heater is larger than the amount of heat generation by the second heater when the apparatus fixes the toner image on the recording material in the second fixing process mode.

8. The fixing apparatus according to claim 7, wherein a grammage of the recording material on which the toner image is fixed in the second fixing process mode is larger that that in the first fixing process mode.

9. The fixing apparatus according to claim 7, wherein the amount of heat generation by the first heater is controlled to become greater than the amount of heat generation by the second heater during warm-up of the apparatus.

10. The fixing apparatus according to claim 7, wherein a rated power of the first heater is greater than that of the second heater.

11. The fixing apparatus according to claim 7, wherein a turn-on ratio of the second heater to the first heater when the apparatus fixes the toner image on the recording material in the first fixing process mode is larger that that in the second fixing process mode.

12. The fixing apparatus according to claim 7, wherein the belt has a base layer and a rubber layer covering the base layer.

* * * * *